US007541938B1

(12) United States Patent
Engelhaupt

(10) Patent No.: US 7,541,938 B1
(45) Date of Patent: Jun. 2, 2009

(54) OPTICAL FLAME DETECTION SYSTEM AND METHOD

(76) Inventor: Darell Eugene Engelhaupt, 84 Jay St., Madison, AL (US) 35758

( * ) Notice: Subject to any disclaimer, the term of this patent is extended or adjusted under 35 U.S.C. 154(b) by 0 days.

(21) Appl. No.: 11/729,653

(22) Filed: Mar. 29, 2007

Related U.S. Application Data

(60) Provisional application No. 60/787,032, filed on Mar. 29, 2006.

(51) Int. Cl.
*G08B 17/12* (2006.01)

(52) U.S. Cl. ..... 340/578; 340/577; 340/600; 250/554; 250/339.13

(58) Field of Classification Search ..... 340/600, 340/577, 578; 250/544, 339.15; 356/213, 356/218, 229, 335–337
See application file for complete search history.

(56) References Cited

U.S. PATENT DOCUMENTS

| | | | | |
|---|---|---|---|---|
| 1,959,702 | A | | 5/1934 | Barker |
| 4,166,917 | A | * | 9/1979 | Dorfeld et al. ..... 136/259 |
| 4,455,487 | A | | 6/1984 | Wendt |
| 4,640,628 | A | | 2/1987 | Seki et al. |
| 4,691,196 | A | | 9/1987 | Kern et al. |
| 4,742,236 | A | | 5/1988 | Kawakami et al. |
| 4,765,413 | A | | 8/1988 | Spector et al. |
| 4,785,292 | A | | 11/1988 | Kern et al. |
| 4,904,986 | A | | 2/1990 | Pinckaers |
| 4,913,647 | A | | 4/1990 | Bonne et al. |
| 5,189,398 | A | | 2/1993 | Mizutani |
| 5,218,345 | A | | 6/1993 | Muller |
| 5,257,013 | A | | 10/1993 | Lewkowicz |
| 5,311,167 | A | | 5/1994 | Plimpton et al. |
| 5,339,070 | A | | 8/1994 | Yalowitz et al. |
| 5,416,325 | A | * | 5/1995 | Buontempo et al. .... 250/339.08 |
| 5,612,676 | A | | 3/1997 | Plimpton et al. |
| 5,625,342 | A | | 4/1997 | Hall et al. |
| 5,644,134 | A | | 7/1997 | Astheimer |
| 5,675,395 | A | | 10/1997 | Martin et al. |
| 5,734,335 | A | | 3/1998 | Brogi |
| 5,961,314 | A | | 10/1999 | Myhre et al. |
| 6,057,549 | A | | 5/2000 | Castleman |
| 6,064,064 | A | | 5/2000 | Castleman |
| 6,071,114 | A | | 6/2000 | Cusack et al. |
| 6,078,050 | A | | 6/2000 | Castleman |
| 6,116,505 | A | | 9/2000 | Withrow |
| 6,135,760 | A | | 10/2000 | Cusack et al. |

(Continued)

*Primary Examiner*—Daniel Wu
*Assistant Examiner*—Hongmin Fan
(74) *Attorney, Agent, or Firm*—James Richards

(57) ABSTRACT

A long range optical sensor and system for detecting the flame of forest fires or other fires while rejecting false alarms due to solar radiation is described. The sensor utilizes a collector optic that collects energy from a wide field of view and concentrates the energy onto a detector. The collector may be a non-imaging collector and may match to a non-planar sensor. In one embodiment the sensor may be arrayed to achieve larger area coverage. In another, the sensor system may be scanned to increase the encompassed viewing area. Larger areas may be covered by RF radio links or networks interconnecting multiple arrayed sensor modules. UVC reflective coatings may include enhanced aluminum with silicon dioxide, silicon monoxide, or magnesium fluoride, or high phosphorous nickel phosphorous. In one embodiment a UVC sensitive Geiger Mueller tube may be coupled to a non-imaging spherical reflective collector. A catadioptric UVC/infra-red flame sensor is disclosed. Refractive or reflective designs are considered.

10 Claims, 11 Drawing Sheets

U.S. PATENT DOCUMENTS 6,150,956 A 11/2000 Laufer
6,153,881 A 11/2000 Castleman
6,208,252 B1 * 3/2001 Danilychev ..... 340/577
6,239,435 B1 5/2001 Castleman
6,329,921 B1 12/2001 Tindall et al.
6,406,611 B1 6/2002 Engelhaupt et al.
6,507,023 B1 1/2003 Parham et al.
6,515,283 B1 2/2003 Castleman et al.
6,516,116 B1 * 2/2003 Murray et al. ..... 385/31
6,518,574 B1 2/2003 Castleman
6,927,394 B2 8/2005 Parham et al.
7,123,154 B1 * 10/2006 Smith ..... 340/600
7,154,095 B2 12/2006 Luck et al.
7,155,029 B2 12/2006 King et al.
2003/0020617 A1 * 1/2003 Tice et al. ..... 340/600

* cited by examiner

OPTICAL FLAME DETECTION SYSTEM AND METHOD

RELATED APPLICATIONS

This application claims the benefit under 35 USC 119(e) of prior provisional application 60/787,032, titled "Multispectral Flame Detection and Reporting", filed Mar. 29, 2006 by Darell E. Engelhaupt, which is incorporated herein by reference in its entirety.

Other US patent documents referenced herein are incorporated herein by reference.

BACKGROUND

1. Field of the Invention

The present invention pertains generally to the field of flame detection, more particularly to the field of flame detection by specifically enhanced optical means to provide for more rapid and accurate reporting of distant or remote fires. The use of RF transmitters is described also permitting a robust long range sensing system to be constructed economically.

2. Background of the Invention

Recent annual United States Federal expenditures for forest and other open area fire protection is about $4.7 billion dollars and about an equal amount is provided by state and county fire protection. An area of forestry burned equal to the size of Ohio or 133,000 square kilometers (approximately 48,000 square miles, 28.5 million acres) in five years from 1998 through 2002. Forest fire damage has increased by more than ten fold in the last fifteen years. The United States presently ranks seventh in total acreage lost but much worse in total value lost from open area fires. It is well known that open area fires destroy indeterminate wildlife, millions of acres of forest and forest products as well as creating about ⅓ of the pollution particulates and $CO_2$ in the US alone. Worldwide wildfires are devastating the entire economy in many countries. Such is the case in Indonesia, North African countries and other countries without sufficient resources to extinguish large fires. Indonesia has lost as much as 50% of the useful forest products in many areas to fires in recent years. Flame and smoke detectors are marketed by as many as 60 companies in the US but have not found widespread use in the detection of forest and open area fires due to the limited range of detection and the lack of reporting systems. Therefore there is a need for flame detection and reporting systems which detect small remote fires and cover a wide area using economical sensors and technologies.

BRIEF DESCRIPTION OF THE INVENTION

Briefly, the present invention pertains to a long range optical sensor and system for detecting the flame of forest fires or other fires while rejecting false alarms due to solar radiation. The sensor utilizes a collector optic that collects energy from a wide field of view and concentrates the energy onto a detector. The collector may be a non-imaging refractive or reflective collector and/or may match to a non-planar sensor. In one embodiment the sensor may be arrayed to achieve larger area coverage. In another, the sensor system may be scanned to increase the encompassed viewing area Larger areas may be covered by RF radio links or networks interconnecting multiple arrayed sensor modules. UVC reflective coatings may include enhanced aluminum with magnesium fluoride or silicon oxide coating, magnesium fluoride, or high phosphorous nickel phosphorous alloy. In one embodiment a UVC sensitive Geiger Mueller tube may be coupled to a non-imaging spherical reflective collector. A catadioptric UVC/infra-red flame sensor is disclosed.

In one embodiment, a coating of nickel phosphorous with the phosphorous at or above 20 atomic percentile has been found to have a good reflectivity at UVC.

A completely solar-blind sensor module may be based on a cylindrical, planar or other Geiger-Mueller tube or a solid state UVC detector with an optical collector.

The dramatically improved performance of the detector over present commercially available units can provide for enhanced response time for the responsible fire fighting agencies to protect homes, industries, forest resources and other jeopardized entities. The addition of a transmitter or transponder augments the remote sensing system.

These and further benefits and features of the present invention are herein described in detail with reference to exemplary embodiments in accordance with the invention.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Figure 1B:
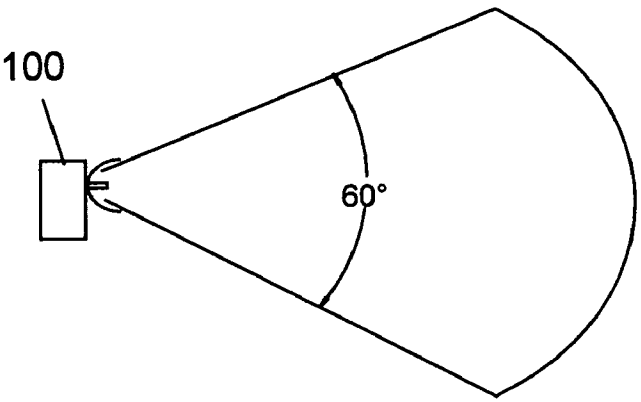
FIG. 1B illustrates an exemplary wide angle and distance coverage area from the enhanced sensor of FIG. 1A.

The United States ranks seventh in total area of forest lost in recent years, yet we have perhaps the best resources available to reduce this. This invention provides for much needed additional fire protection not presently available to detect and report small wildfires at the earliest possible time.

The present invention utilizes optical collectors and sensors in unconventional arrangements particularly adapted for fire detection. In particular, non-imaging collectors may be used with non-planar detectors, or imaging collectors may be used with non-planar detectors that do not offer a flat surface to match the image plane. Non-imaging collectors may include spherical reflectors and other related shapes that may be economical to produce but have severe aberrations with respect to an imaging application. The aberrations, however may match a non-planar detector, providing good energy collecting performance over an extended field of view (FOV). An exemplary non-planar detector is a Geiger Mueller (GM) tube designed for UVC detection. The GM tube presents a linear tubular shape with sensitive wire electrodes within the tube. In one embodiment, the length dimension of the detector may run perpendicular to a focal plane, where a conventional planar detector would be mounted. (See FIG. 1A.) The objective of the optic for flame detection is energy collection from a wide field of view and coupling of the energy to the detector as distinguished from imaging a scene onto a planar detector array.

A typical high-end optical flame detector with electronically enhanced detection to determine flicker, multiple band energy and spectral scanning will detect a test fire of a petroleum fuel, i.e. kerosene, in a 25 cm pan with a flame height of about 1 meter or a corrugated paper panel of about 0.5×1 meter stacked 0.25 meter high, at a distance of 20 to 30 meters. Satellites operated by the US government can detect a minimal forest fire of about 2 kilometers diameter on a clear day or night in a single pass over the area within about 90 minutes using imaging methods, if instructed to do so. From this point the satellite will monitor the growth of the fire for about a 0.5 to 2 minute period while within detection range during each 90 minute orbit if it is not cloudy in the area. The present invention combines specific non-imaging optical components and detectors to permit detection of a single kitchen (1 cm^2) match flame at a distance of 100 meters whether in bright sunlight or darkness. A small fire such as the test described above with burning kerosene in a 25 centimeter pan can be detected in sunlight at 300 meters or more. A true forest fire can be detected as much as 8 kilometers away with a very small collector of 10 to 20 cm diameter. Since optical losses are related to the square of the distance from source to detector (Intensity=1/Dist^2), this is an improvement of about 75 to 100 to 1 for a collector equipped detector over an available detector which has no collector. The enhanced performance is achieved as follows.

Flame Photonics

Flame photonics are complicated and involve the fact that a fire emits radiation from sound to ultraviolet, with deep infrared (heat) to visible radiation obeying Planck's laws of radiation. Stephan-Boltzmann law would assign increased radiant energy as the fourth power of the absolute temperature and Wien's displacement law will provide for increased energy at shorter wavelength at higher temperature. Wood (cellulose) fires reach about 1000 degrees Kelvin with occasional bursts from terpenes to 1200-1300 K, providing substantial radiant energy at 2.5 to 5 microns in the infrared. Typical terrestrial sky temperature is rarely higher than 300K. However fire also emits even shorter wavelengths outside the wavelength and temperature considerations for blackbody radiation. Due to the rapid decomposition of material, the outer orbital electrons in the material decay rapidly to lower shells with the emission of photons in the visible and ultraviolet range. Especially of interest is the fact that this radiation extends into the very short UV range of UVC (UVA longest at ~400-320 nm, UVB at 320 to 260 nm and UVC shortest at 260-185 nm). There also are discreet visible emissions present as visible colors due to emission lines of the various materials burning. See FIG. 10. Solar emission provides these wavelengths also and on into XUV and x-ray wavelengths starting with infra-red. In order to separate the remote fire from the rest of the radiation present in the environment (false alarms), spectral filtering is presently used but broad band emission detection and analysis requires the use of two or three detectors to cover the range of flame emissions. This greatly increases the complexity and cost yet does not significantly improve the range. It is known that the upper atmospheric ozone will filter the short wavelength UVC emitted by the sun and virtually eliminates this radiation at the earth's surface. UVC is a much lower portion of the photonic energy from a flame than IR or visible, however is not strongly available from the sun at the earth's surface. Therefore a detector sensitive only to UVC will be very nearly solar blind. Additionally the fire generates sound from low frequency audible to 40 kHz ultrasound as the material decomposes due to rapid steam formation and cell disruption.

Principles of Operation

One distinct merit in the present invention is that the range of flame detection can be increased dramatically by the implementation of the specially designed and coordinated optical collector component. Another merit is that by using a collimated optical collector, the field of view can be limited and as such the angular position can be determined providing location information in very short time to the forestry or other departments. Yet another advantage is that the sensor can be completely solar blind in broad daylight disallowing solar interference creating false alarms. The dramatically improved performance of the detector over present commercially available units will provide for enhanced response time for the responsible fire fighting agencies, home owners or jeopardized entities.

The range of detection of the flame is so improved by increasing the area of the viewing optical collector which permits more energy to be deposited on the detector. This however must be done such that the increased energy is not providing false alarms due to increased solar or other energy placed upon the detector. Also any increase is directly related to the reflectivity of the collector material at the wavelength of the detector and second order related to the distance of the original path and also second order to the distance of the reflected path to the sensor. This last fact is very often overlooked in energy calculations for detectors when imaging principles are considered. The present optical methods do not rely on imaging principles as will be described.

By collimating the energy in a small field of view with the collector it is possible to achieve a higher gain at the detector as is common in a telescope. In order to achieve a high sensitivity and a wide field of view multiple sensor packets can be combined. Further sensitivity can be achieved with a single collimating collector/detector unit by scanning the unit. An additional method of improved angular and range resolution is achieved by using a torroidal optical reflector and a segmented detector. While segmented UVC optical detectors are not yet commercially available, single element silicon carbide (SiC) and diamond like coating (DLC) devices have been tested in Russia and slightly broader band units have been tested in the US. Within a short time it is anticipated that a circular, segmented solid-state UVC detector will be available. This will permit such an arrangement with a single multi-element detector. Multiple single element detectors can be used also in the mean time.

Since the Geiger-Mueller (GM) detector does not conduct when no UVC is present, the only power requirement is the oscillator bias. This will draw only a few tens of microwatts for some brands of UVC detectors. Thus the sensor can remain active on small batteries for years and with solar cells the power is sufficient for continuous monitoring. Commercial sensors are available for monitoring boiler flames and pilot lights as well as some flame detectors used for protection. Therefore the cost is minimal at a few tens of dollars US for the completed UVC detector and amplifier package. The digitally coded RF transmitter, if used, is off unless a fire is detected and so draws no current during the off time. A small low current receiver can be used with the system for periodic remote checking and will be powered by solar cells and a battery.

Collector Designs

Collectors for both radiant and emission energies can be made to coincide in the same unit. Since the solar blind issue can be resolved by selecting a UVC only detector, a simple solution to the increased range is to use only the one detector with a UVC compatible collector to increase the range. For efficient imaging optical quality reflection of UVC it is necessary to have a very smooth surface with little deviation from the ideal form. The surface must have high efficiency reflection as well. Such imaging optics are very expensive. However since the image quality is of no concern, the figure and finish for flame detection need not be as good as for imaging. The reflectivity does need to be high. Enhanced aluminum for UV reflection is an aluminum surface deposited in a vacuum followed by a coating of silicon dioxide, silicon monoxide, or magnesium fluoride to protect the aluminum from oxidation. The protective coating is typically ¼ wave at the band of interest and multiple layers may be deposited for greater toughness. The protective coating is typically applied in the same vacuum chamber process, without breaking the vacuum, to prevent any oxidation of the aluminum surface before the protective coating is applied. This surface can be made to reflect with 90% efficiency or better in the entire ultraviolet A-B- and C bandpass. UV enhanced aluminum with a reflectivity greater than 85% from 250 nm to 500 nm may be obtained from several sources, such as Melles Griot, Emund Scientific, and Nova Phase, Inc.

By comparison, an aluminum surface brightly polished but not coated will not reflect better than 50% and will rapidly degrade from this point to nearly zero UVC reflection due to oxidation. An enhanced aluminum surface is preferred in the embodiment of the invention. Gold and silver will not reflect efficiently at all. An optional coating is found to be about 75 to 80% reflective in UVC is nickel phosphorous (NiP) with very high phosphorous of 20% At wt phosphorous or more achieved by electrodeposition, deposited in accordance to U.S. Pat. No. 6,406,611, which is incorporated herein by reference in its entirety. Therefore a low cost collector was made by electrodeposition of NiP 20% At wt P to 0.05 mm then electrodeposition of nickel to a thickness of 0.25 mm. This collector was replicated many times from the same polished hemispherical mandrel by conventional electroforming principles. A further enhancement in cost and time was achieved by using a commercial hemispherical dome for security cameras, coated with a conductive film then coated with either enhanced aluminum or NiP 20% At wt phosphorous.

Similar procedures with other geometric reflective or refractive designs are discussed in the articles of provisional application 60/787,032, titled "Multispectral Flame Detection and Reporting", filed Mar. 29, 2006. For example a parabolic collector of revolution or a linear parabolic collector could be made with the same procedures to enhance the gain and provide a more narrowed field of view (FOV) either vertically or horizontally.

Field-of-View

Commercially available flame sensors use a variety of detectors or in some more expensive units, multiple detectors for increased bandwidth. None of the known flame sensors use a collector or collimator to increase the collected energy substantially. The typical field of view is broad to about 90 degrees due to the detector simply "staring". See FIG. 2.

A simple spherical collector is considered to be a very poor optical lens or mirror for imaging as the low 'f' number or the ratio of the distance to the image plane and the diameter of the major sphere is a small number which leads to very poor imaging qualities if the image is large or off-axis. However in this invention the image is of no concern and in fact non-imaging low 'f' number collectors are desirable as will be described. If the fire is small and directly in line with the collector and cylindrical detector in FIG. 1, the energy will be reflected to the point ½ the distance to the center of the sphere. This will provide a detected energy gain of about 50 for a ten cm diameter or 90 for a 20 cm diameter UVC mirror with reflectivity of about 0.8, directed onto a 0.5 cm diameter axial detector. If the fire sensed is off the axis of the collector/detector unit then the energy is directed to a point along the axis of the GM tube. Thus the detection process proceeds increasing the total field of view for a spherical collector to a maximum of about 90 degrees. Thus both unusually high gain and a broad field of view are achieved. For an imaging system the image would leave the image plane and be blurred and decreased in energy. So a very poor imaging collector makes an excellent non-imaging flame detector using an axial or horizontal GM detector in accordance with this invention.

Therefore one may cover wide areas by concentrating the optical energy and use only four sensors arrayed to recover coverage area (angle) up to 360 degrees yet have the advantage of gain of 100 or more without solar interference. Other designs with greater angular resolution (smaller FOV) will have higher energy detected gain and may use scanning principles to view up to 360 degrees. Additionally the use of flat segments can be used to provide a stationary 360 field of view using multiple detectors as shown in provisional application 60/787,032. An additional enhancement for flame detection is the use of catadioptric optical methods. In order to assure no false alarms an extension to the present processes described is to use a collector which is reflective at one bandwidth and transparent at another. With the proper design, it is possible to reflect IR and transmit UVC. This can be done with a high grade of quartz. Also the possibility of reflecting UVC and transmitting IR is possible using magnesium fluoride, strontium fluoride or other IR transmitting materials known. A design would encompass either two collectors in series or in parallel (basically two units) or a single collector with a reflective surface for one bandwidth energy and a design for refractive collection of energy on a second detector. This may be referred to as catadioptric.

EXAMPLES

Demonstration by way of the following examples has been accomplished.

1.0 A commercial Geiger Mueller "UV TRON" detector from Hamamatsu, Inc. was tested in accordance to the advertised specifications. The performance of the UV TRON was measured prior to adding the collector and found to be better than the advertised specification of 5 meters with detection of a one cm^2 flame (kitchen match) with a 90 degree FOV at about 7-8 meters. This same detector was tested in an environment of intense UVA mercury vapor lights and did not respond to the lighting. Likewise it was tested in bright sunlight directing the detector to the sun. Again it did not respond without the flame. It performed as advertised. The same detector was then configured with an electroformed collector with first surface of 20% phosphorus and balance nickel. The collector was placed with the GM tube axially aligned such that the mid-point of the GM tube was at the spherical focal point. The diameter of the spherical segment was 10 centimeters and the radius of the sphere was 12 cm. The collector area to detector area was then about 100:1 and the f# was less than 1 (Note there is no specific focal plane). The 1 cm^2 flame was then detected to a range of 100 meters or about 12-14 times the distance. The same test was performed in bright sunlight with the collector pointed towards the sun. Again there was no response in the absence of the flame and with the collector the flame detection range was the same as with no sunlight. The FOV of the spherical collector was about 90 Degrees.

2.0 A commercially available detector (Fire Scout, Boulder, Colo.) using the same Hamamatsu UV TRON but operated in accordance with U.S. Pat. No. 7,123,154, was tested similarly and the range with the collector was 120 meters for a 1 cm^2 flame and still the unit was completely solar blind. This unit was tested also without the collector and had a range of detection of approximately 10-12 meters which is an improvement over the original device in accordance to their claims. However the addition of the collector in accordance to the present invention made a detection range improvement of many times the improvement observed using U.S. Pat. No. 7,123,154 with either the original Hamamatsu or Fire Scout modified units. The FOV was about 90 degrees with or without the collector.

3.0 An aluminum parabolic collector with a diameter of 25 cm and no UVC enhanced coating was tested on the above sensor. No noticeable improvement in detection was achieved. This is in accordance to the poor reflectance of non-enhanced aluminum in the UVC band.

4.0 A gold coated plastic security camera dome (Critereon, Inc. Atlanta, Ga.) of similar dimensions to the electroformed collector was tested as a collector on the above unit and no improvement in detection was achieved. This is in accordance to the poor reflectance of gold in the UVC band.

5.0 This dome was coated with the very high phosphorus >20% P, electrolytic deposit in accordance to U.S. Pat. No. 6,406,611, and performed similar to the electroformed collector providing for means to manufacture low cost UVC collectors.

6.0 A 0.5 mm fused quartz window was applied to the electroformed collector for protection from the elements. A loss of 4-5% in transmission of UVC was measured on a Cary spectrophotometer. A thin plastic film of commercial food wrapping was measured and had a loss of less than 8% in the UVC by the same measurement. Thus allowing means for low cost protection.

7.0 A novel very low cost infra-red (IR) unit with a detection band limited to 1.5-2.5 microns was built using a commercial solar panel of 2×5 cm. This panel of course was very sensitive to the sun without filtering. A filter was built comprised of crossed polarizing film to block visible light to less than 1%. This device would detect a 1 cm^2 flame at about 7-10 meters. When directed towards the sun it would sense the sunlight at about the same intensity as the small flame at 5 meters. A collector was added comprised of a 25 cm diameter non-enhanced aluminum parabolic collector and the range to detect the 1 cm^2 flame with IR increased to 60 meters with a FOV of about 45 degrees. The detection of solar energy also increased accordingly when the collector was directed towards the sun. A unit comprised of such an arrangement would require flicker detection or other known means to become solar blind. Units facing away from the sun will function well. A population of such sensors facing north in the northern hemisphere would not detect the sun. Thus, in one embodiment of the invention, a number of IR sensors may be configured to cover a large forested area by using collecting optics to provide wide angle distance coverage for the sensor, but rather than configuring each IR sensor location to cover 360 degrees, the same area may be covered by populating the forest with 90 degree IR detectors pointing north to avoid angles that would be blinded by observing the sun at some time during the day.

8.0 A much more expensive IR gallium aluminum arsenide detector was used to replace the filtered solar cell. This detector has a natural response of 2.2-2.9 microns. A match flame could be detected at about 60 meters and a butane torch flame could be detected at about 100 meters with a FOV of less than 30 degrees using the aluminum collector when directed away from sunlight. The sun (in the FOV) could be detected at the intensity of the small flame at 10 meters, beyond which the match was not distinguished from the sun without further means such as flicker detection circuitry.

9.0 The UVC detector with the nickel phosphorus/nickel collector and quartz window was compared to the GaAlAs detector with the aluminum collector using a 25 cm pan of diesel fuel as source of the flame. Both detectors would detect the flame 10 times as far with the respective collector as without. The IR detector performed in accordance to the figure of merit data described herein with respect to FIG. 9 with long range detection achievable in daylight but not when directed towards the sun. No similar data was prepared for UVC emission detection since energy in the UVC band incorporated was not detected from solar energy. A table of emission data is provided in FIG. 10.

10.0 Two transponders (Microchip Technologies, Inc. Chandler, Ariz.) were connected to separate flame sensor units. One had inputs from three separate sensors each coded for identity, modified, unmodified and smoke detector. The other had only the long range optical sensor. All sensors could be identified remotely by the received sensor code assigned when activated.

These embodiments are typical and are not all inclusive as those skilled in the arts of UV and IR optics, flame chemistry and photonics and those skilled in digital RF communications will find similar new applications for advanced sensing of remote fire and reporting the signals from these advanced sensors. The use of refractive optics with non-imaging sensors is an option. The primary objective of this application is to demonstrate the remarkable improvements achieved by the construction and testing of these demonstrated advanced flame sensors. It is demonstrated that totally solar insensitive devices with flame detection improvement of as much as 100:1 sensitivity of intensity has been accomplished through this effort. These tests also indicate that these improved sensors could be used in remote locations at very low capital or maintenance cost. Remote reporting by digital RF transponders further enhances the utility of these sensors as autonomous remote fire sensors thus enabling a viable remote system.

Figure 1A:
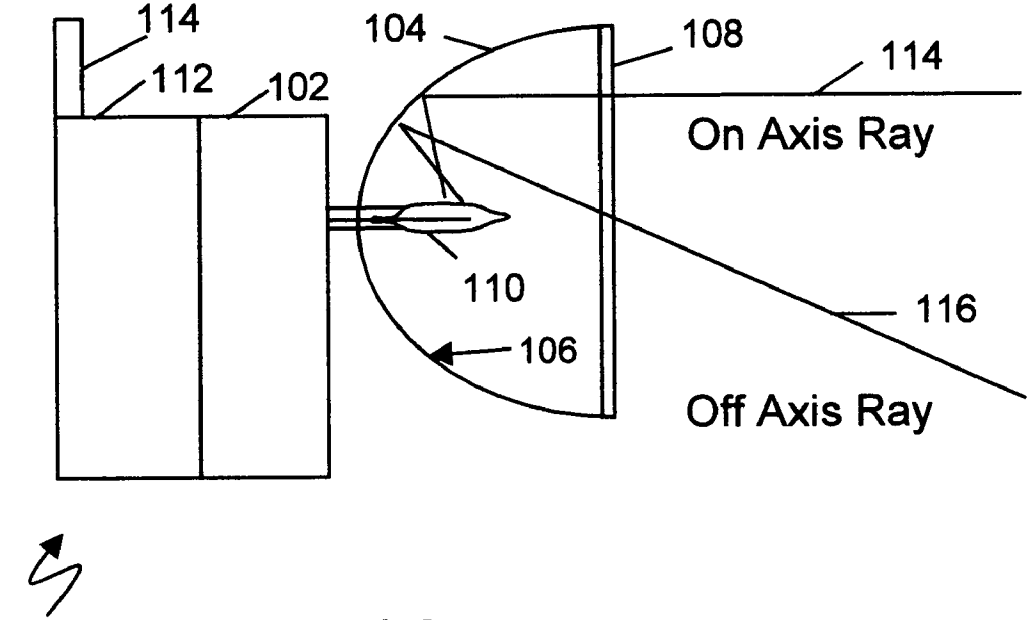
FIG. 1A shows an enhanced flame detector employing an exemplary optical concentrating collector in accordance to the present invention.

FIG. 1A shows an enhanced flame detector employing an exemplary optical concentrating collector in accordance to the present invention. FIG. 1A shows a UVC flame sensor with spherical collection optics and transponder with 60 to 90 degrees circular field of view (FOV). Referring to FIG. 1, the sensor 100 comprises a UVC detector 110 (a Geiger-Mueller tube is illustrated). The UVC detector 110 is optically coupled to a concentrator 104 with a UVC coating 106. A spherical concentrator 104 is shown. The space inside the concentrator 104 is protected from contamination by a UVC transmitting window 108, which may typically be quartz or UVC transmitting plastic. The UVC detector 108 is electrically coupled to an electronics module 102 for biasing the detector, amplifying the signal from the detector and processing the signal to determine detection of flame. The detection signal is then sent to a transponder 112 coupled to an antenna 114 to report flame detection.

The shape of the spherical concentrator 104 may be determined by structures made by economical processes such as injection molding, electroforming or other economical replication processes. The UVC reflective coating 106 may then be applied to the surface.

It may be observed from FIG. 1A that the sensor presents a vertical sensitive length in contrast to a typical semiconductor sensor, or focal plane array that presents a plane to match the focal plane of a typical optical system. Further, that the on axis ray and off axis ray impinge on the vertical sensing length of the detector in the absence of a focal plane, allowing concentration from a wide angle. The sensor of FIG. 1A is oriented with the length axis collinear with the axis of symmetry of the collector, which is perpendicular to the orientation of a typical conventional focal plane sensor. The sensor of FIG. 1A may utilize a number of different curved shapes for the collector. When the curve is a sphere, the spherical aberration is well matched to the linear detector because rays from different radii in the aperture impinge on different portions of the length of the detector, allowing efficient collection on axis as well as good collection off axis as described above. The same observation may be made for other conic section based shapes including ellipsoidal, and hyperboloidal. For a paraboloid, all radii impinge on a particular length, but in contrast to a small single detector, off axis energy is collected; whereas, off axis energy would be entirely missed by a single detector of similar cross section. Thus, the sensor gains benefit of a wider field of view by virtue of the length and non-image plane orientation of the detector. Further, the sensor gains benefit of a wider field of view by virtue of the aberrations of the curvature of the collector. Further, for the particular configuration of FIG. 1A, the aberrations cooperate with the shape of the detector to provide efficient and wide angle response. Further, for a sphere, the collector may gain economical advantage because a sphere is easier to produce using lower cost techniques than other conic section based shapes.

FIG. 1B illustrates an exemplary wide angle coverage area from the sensor of FIG. 1A with a spherical concentrator. A single point sensor would have a narrower field of view with the concentrator, however the GM tube, with the sensing length has a wider field of view.

Figure 1C:
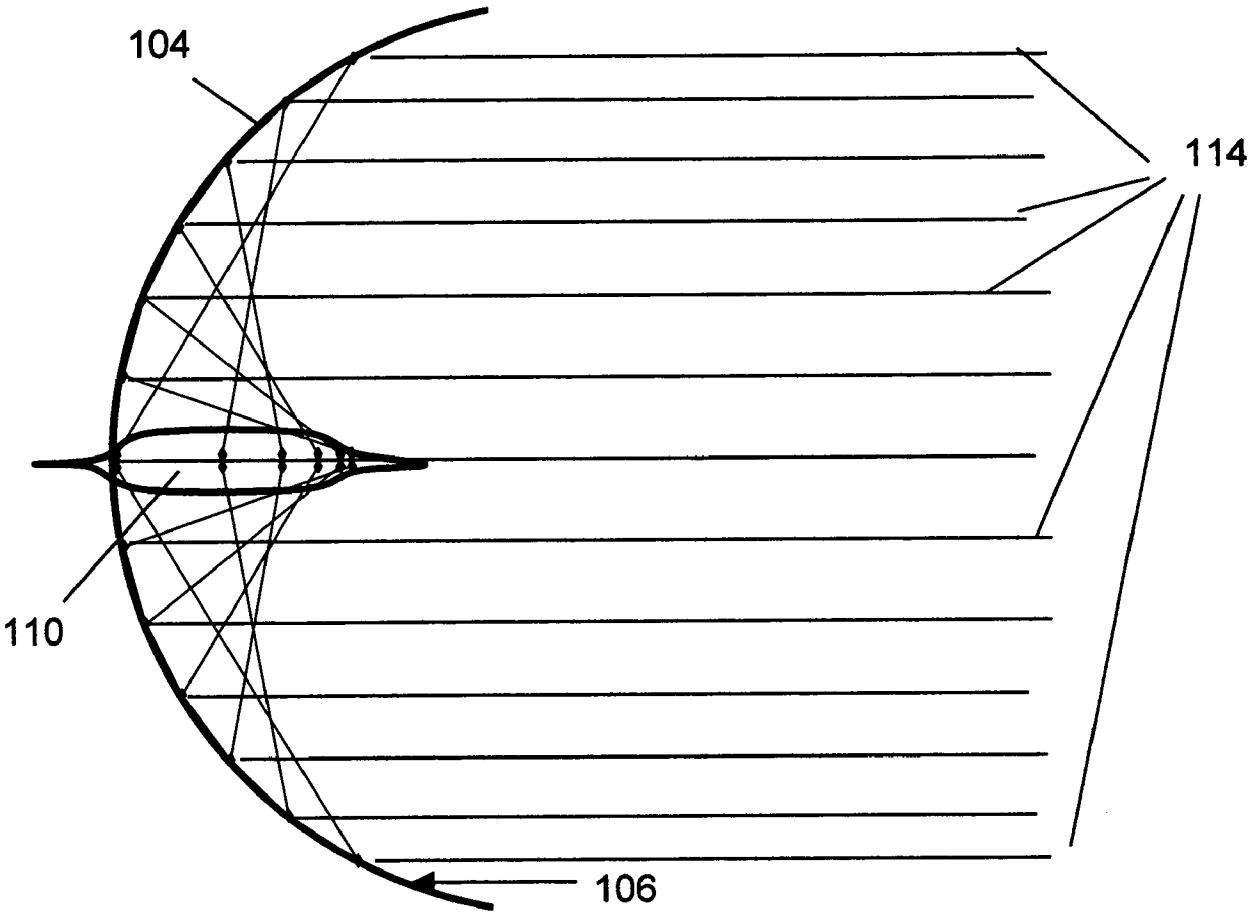
FIG. 1C illustrates a raytrace of an exemplary spherical reflector with cylindrical sensor.

FIG. 1C illustrates a raytrace of an exemplary spherical reflector with cylindrical sensor. Referring to FIG. 1C, on-axis rays 114 reflect off of the UVC reflective coating 106 on the mirror 104 and are directed to the sensor 110. The rays 114 do not converge to a single focal point, but are distributed along the length of the tube 110. The distribution spreads the energy along the length of the sensor, which also spreads any heat energy as may occasionally occur if the sun's path traverses the field of view of the sensor. Note also that the tube 110 is capable of receiving energy from all angles presented to the tube including forward and backward angles, i.e. greater than and less than 90 degrees from the axis. It may be appreciated that the rays 114 are generally concentrated in the region of the detector 110 such that the detector 110 is well positioned to receive energy from off axis rays (not shown). Note that other conic section based shape mirrors will also couple to the sensor and have similar beneficial optical properties like the spherical mirror, although will likely be more expensive to produce. It may be also appreciated that although the spherical reflector works well, a more complex shape may be developed to match a particular detector at potentially higher manufacturing cost than the spherical reflector shown.

Thus, it may be observed that although the spherical mirror would be considered to be unusable for imaging applications because of the extreme spherical aberration, the shape of the sensor cooperates with the spherical distribution of energy such that the spherical aberration is accommodated and poses no degradation in performance.

Figure 2B:
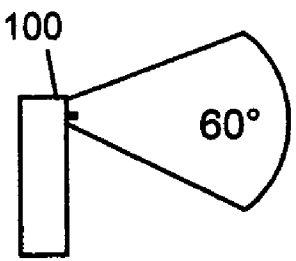
Fig. 2B Prior Art
FIG. 2B (prior art) illustrates the reduced distance coverage of the prior art.
Figure 2A:
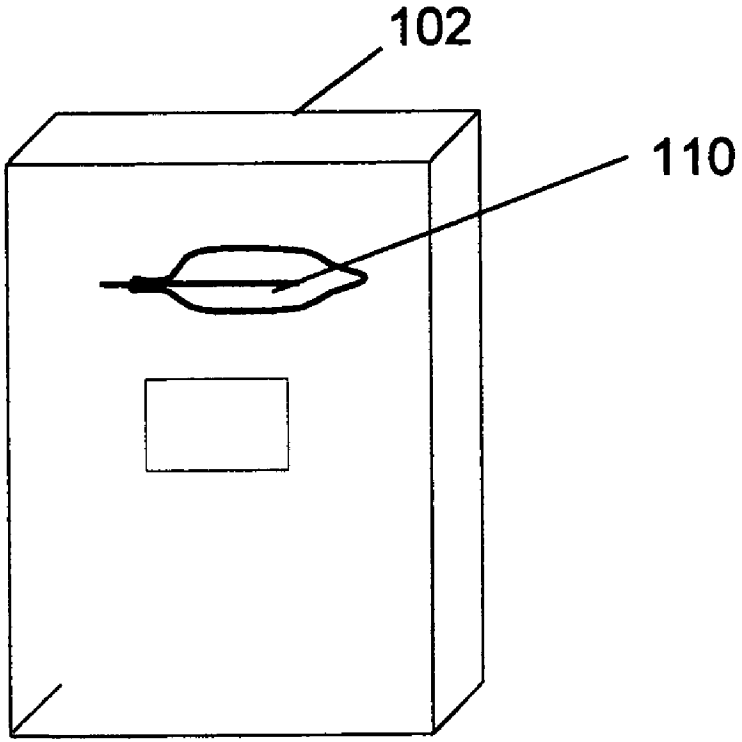
Fig. 2A Prior Art
FIG. 2A (prior art) illustrates a conventional UVC flame sensor.

FIG. 2A illustrates a conventional UVC flame sensor. The conventional UVC flame sensor has no collection optics and has a FOV 60-90 degree horizontal and 90 degrees elevation. The conventional sensor has no collector and only the detector is exposed to the potential fire. This permits a detector collection area less than half of the geometric area of the sensor for a cylindrical sensor and less than 1% of the mirror collector area described. The use of planar Geiger Mueller sensors allows somewhat better performance but is still limited to the area of the device for collection. Solid state devices are typically smaller and further limit sensitivity.

FIG. 2B shows the relative reduced range of energy collection of the prior art with similar FOV to FIG. 1B.

Figure 3:
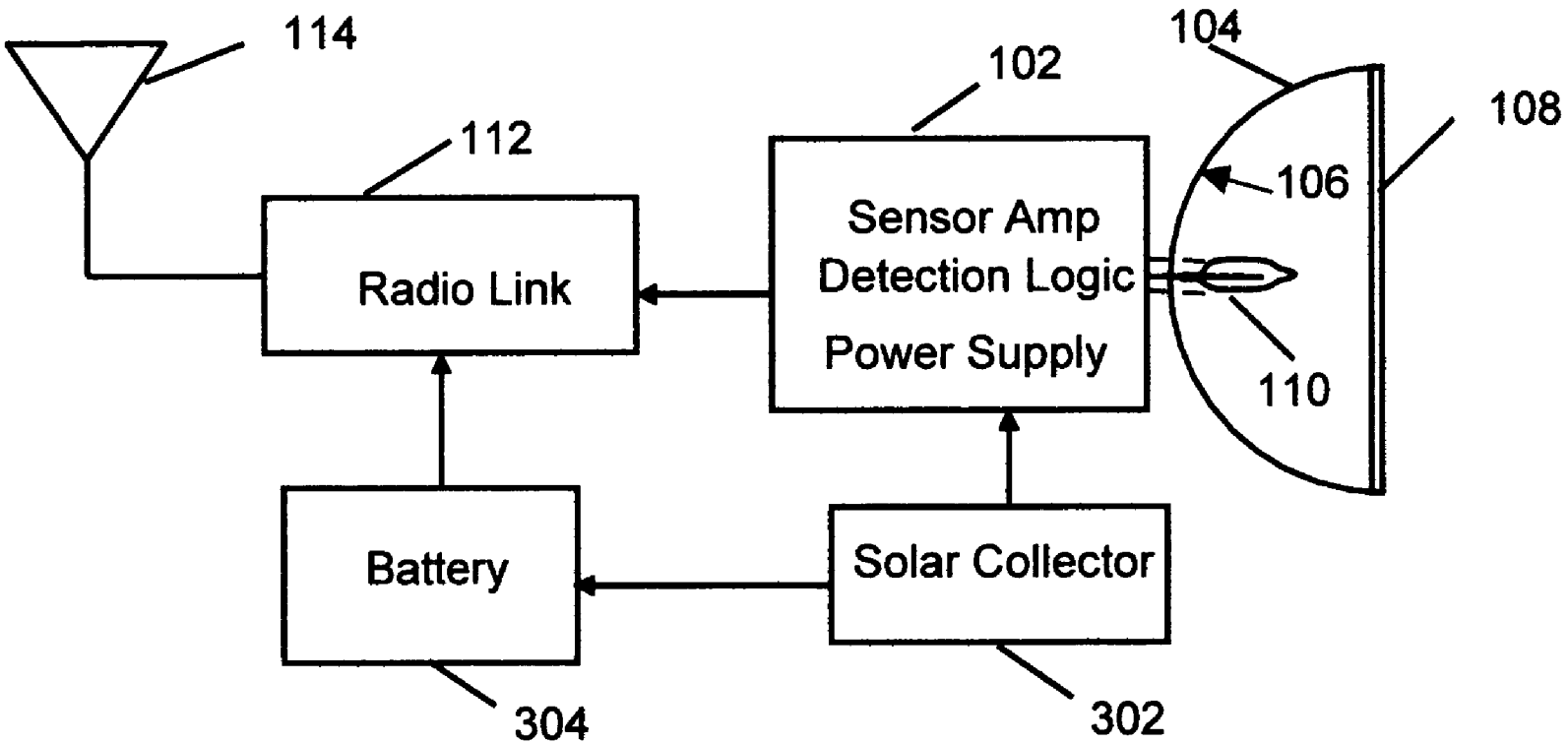
FIG. 3 illustrates a fielded unit capable of detection and reporting of remote fires.

FIG. 3 illustrates a fielded enhanced unit capable of detection and reporting of remote fires. The system of FIG. 3 comprises the UVC detector 110, concentrator 104, window 108, electronics 102 and transponder 112 of FIG. 1. The unit of FIG. 3 may use a solar collector 302 or battery 304 or in conjunction with the battery 304 to provide power indefinitely in a remote location. Alternatively, where the location is close to power lines, a sufficient amount of power may be coupled by induction from proximity to the power lines.

Figure 4A:
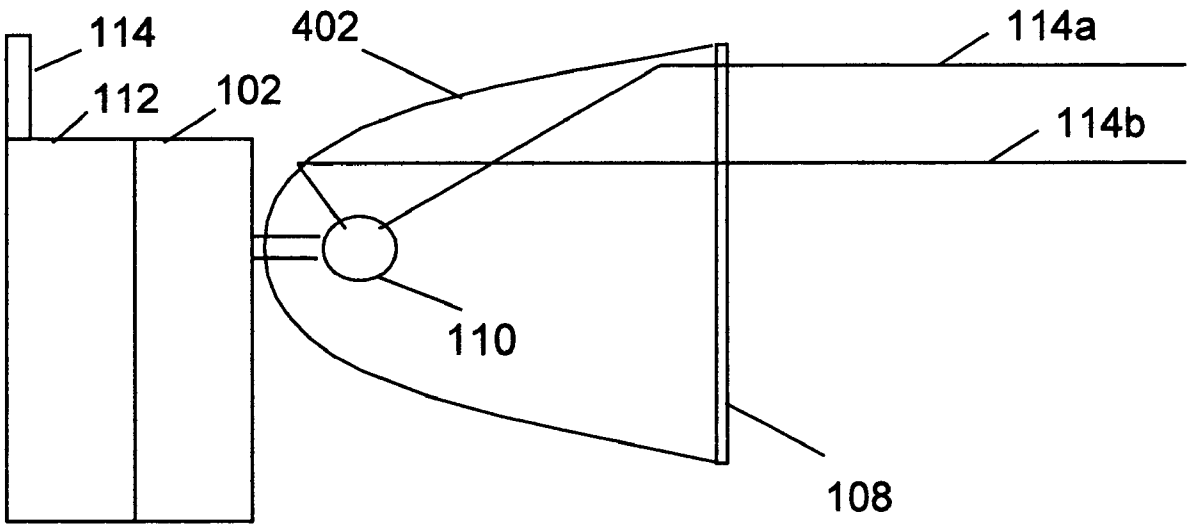
FIG. 4A and FIG. 4B show a side view of a linear parabolic concentrator.
Figure 4B:
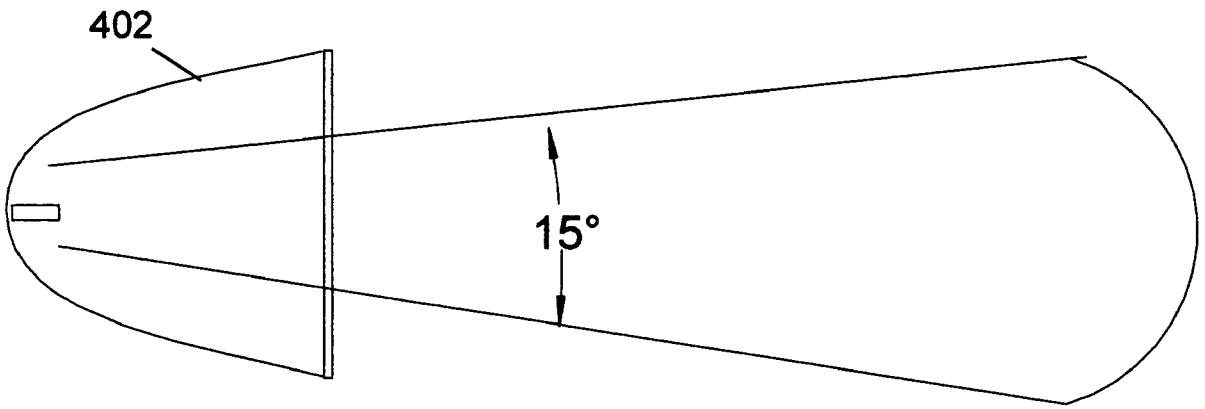

FIG. 4A and FIG. 4B show a side view of a linear parabolic concentrator. The parabolic concentrator 402 may give the system a field of view 10 to 30 degrees horizontal and 2 to 15 degrees in elevation. Note that the sensor 110 is positioned so that the length dimension of the sensor runs parallel to the linear dimension of the linear parabolic concentrator. Two on axis rays 114*a* and 114*b* are shown. Note that the detector may receive energy from any angle including in front of (ray 114*a*) and behind (ray 114*b*) the detector, in contrast to a focal plane detector, which can at most present a 180 degree acceptance angle to the concentrator. This observation also applies to the detector orientation of FIG. 1A.

Figure 5:
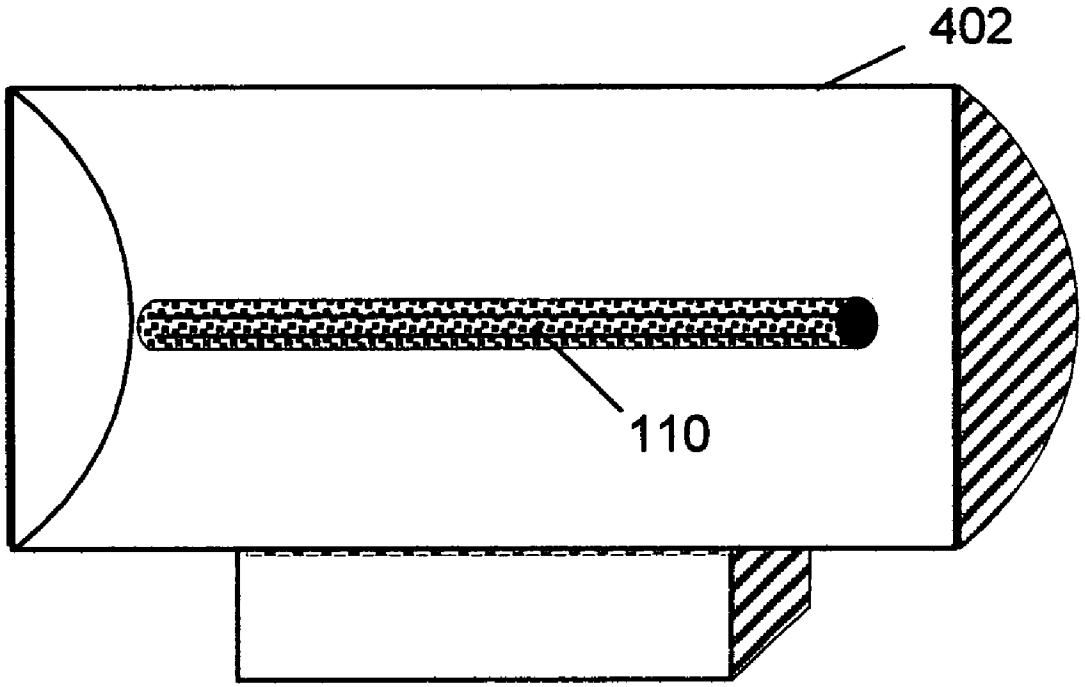
FIG. 5 shows a front diagonal view of the linear parabolic concentrator of FIGS. 4A and 4B.

FIG. 5 shows a front diagonal view of the linear parabolic concentrator of FIGS. 4A and 4B. The linear parabolic concentrator allows the use of a long detector tube while providing a narrow field of view in the vertical plane of the parabola and a wide field of view in the horizontal plane of the linear dimension.

Figure 6A:
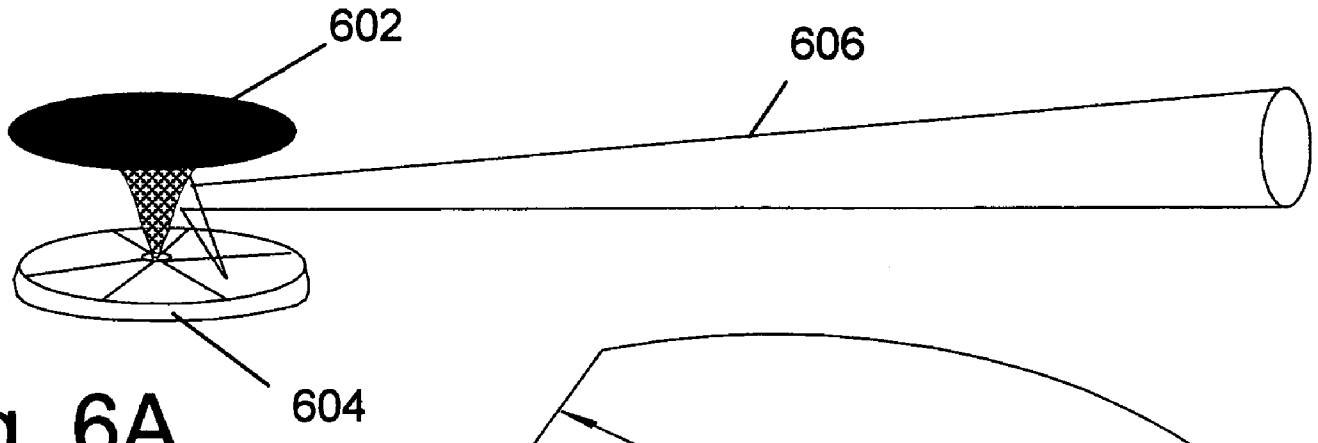
FIG. 6A shows a multiple element solid state sensor coupled to a toroidal or "Trumpet" optic to detect and identify the angular position of a fire.

FIG. 6A shows a multiple element solid state sensor coupled to a torroidal "Trumpet" optic to detect and identify the angular position of a fire. FIG. 6A shows the Trumpet optic optically coupled to an array of sensors. The trumpet optic produces a narrow vertical field of view 606. The smooth trumpet optic as shown is slightly divergent in the azimuth direction; however the trumpet may be made from a sequence of merged spherical or paraboloidal sections directed to each corresponding sensor segment for improved collection efficiency. Note also the orientation of the sensor elements is orthogonal to the parabolic axis of the trumpet.

Figure 6B:
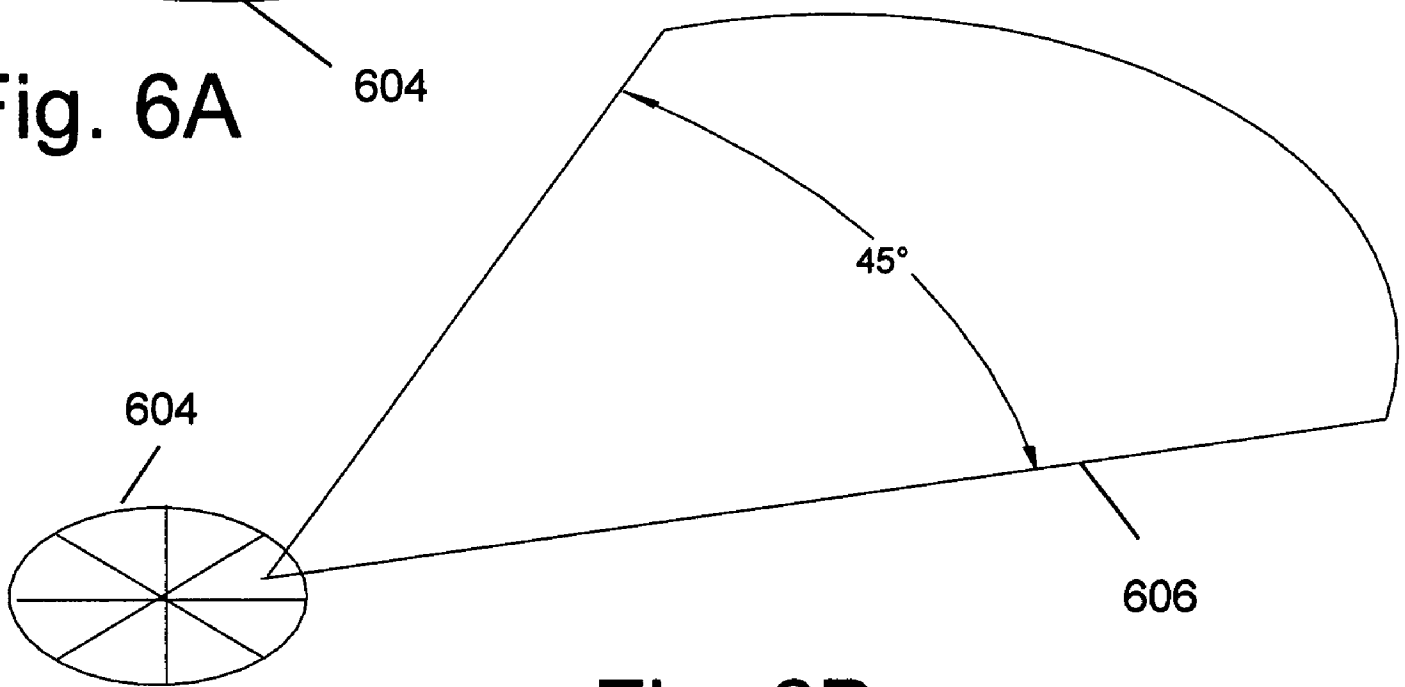
FIG. 6B shows a bottom view illustrating the FOV per segment for the toroidal sensor of FIG. 6A.

FIG. 6B shows a bottom view illustrating the FOV per segment for the "Trumpet" sensor of FIG. 6A. The view of 6B illustrates the azimuth field of view 606 of one sensor element of the array. The total array may have a full 360 degree coverage, but each sensor covers a portion of the total coverage allowing directional determination of the detection of a fire.

In an alternative embodiment, the sensor of FIG. 1A may be mounted on a rotational mount and scanned in azimuth to provide a full 360 degrees of direction indicating coverage.

Figure 7:
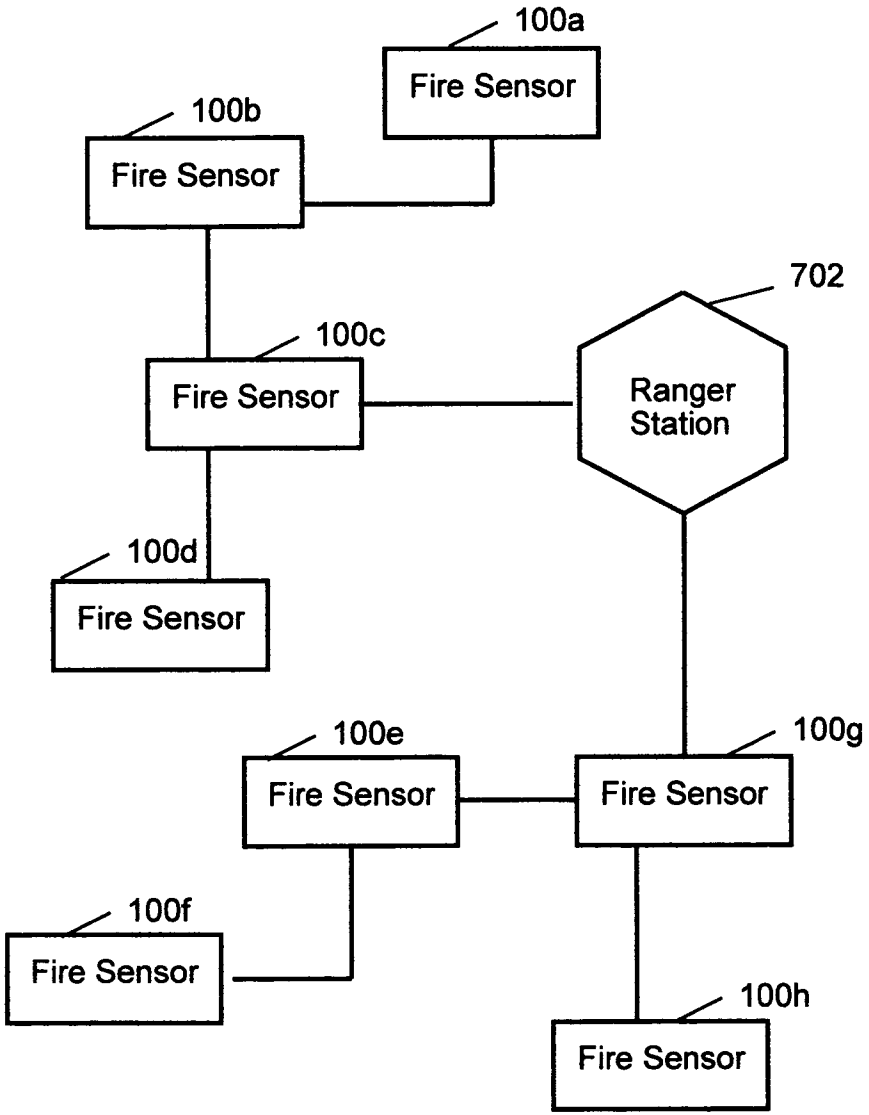
FIG. 7 illustrates an exemplary network of sensors with digital transceivers.

FIG. 7 illustrates an exemplary network of sensors with digital transceivers. Referring to FIG. 7, each sensor unit (100*a*-100*h*) accepts multiple alarm inputs and sends to neighboring corresponding coded Tx/Rx sensor. The code is forwarded (daisy chained) until received by central processing station (702). The information for location and sensor is in the code and no GPS is required since upon installation the code for each is recorded. Identically addressed Tx/Rx pairs may be used with different codes to minimize interference and pass information to a common address at control station. Many schemes are possible including multiple detection methods to eliminate false alarms and cameras triggered by the sensor to view and transmit video.

Figure 8:
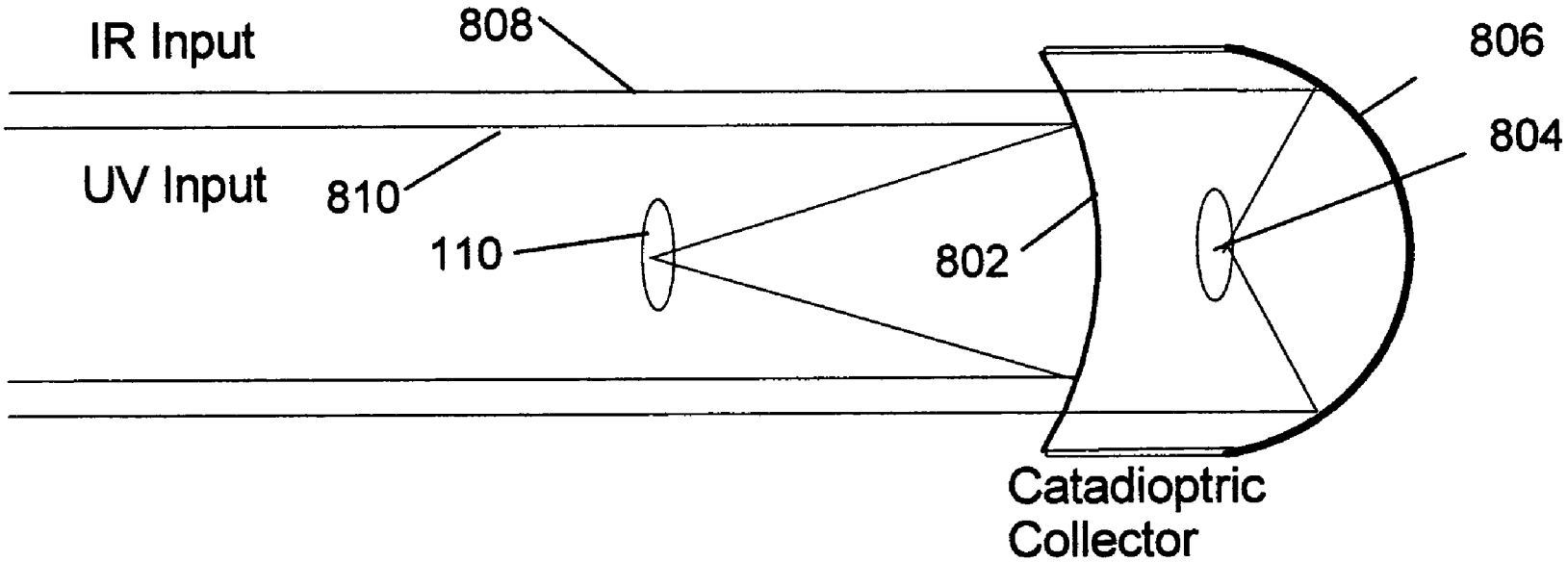
FIG. 8 illustrates a dual band optical collector for increased sensitivity.

FIG. 8 illustrates a dual band optical collector for increased sensitivity. Referring to FIG. 8, energy comprising both UVC and infrared from a flame is observed by the sensor system. A first optic is reflective for UVC and transmissive for infrared. The first optic is formed as a concentrator for the UVC detector. Infrared radiation passes through the first optic and is reflected by a second optic to an infrared detector. Candidate materials for the first optic include but are not limited to selenium, magnesium fluoride, strontium fluoride, or BK7 glass. The second collector surface may be aluminum, copper, some glasses or other IR reflecting materials.

Figure 9:
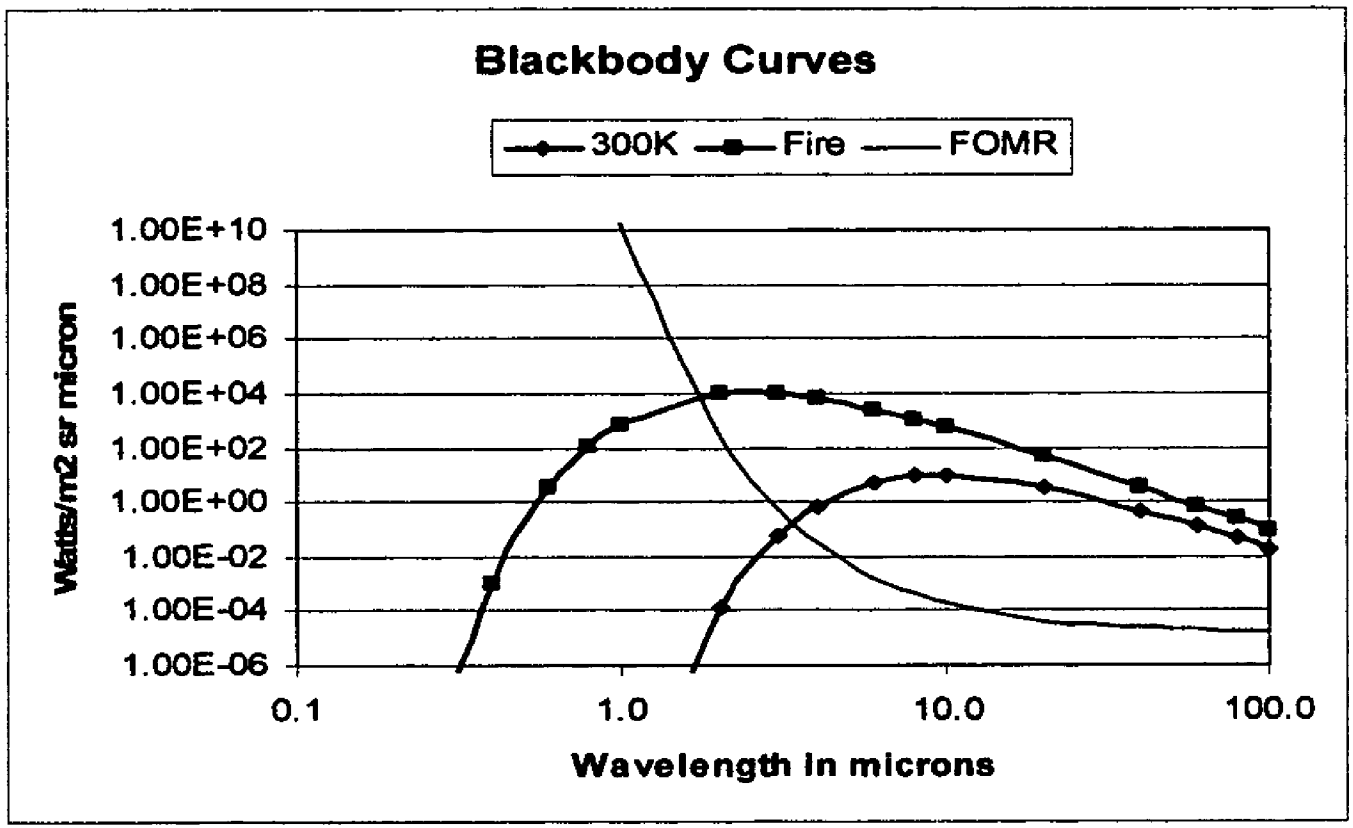
FIG. 9 illustrates the calculation of figure of merit for IR flame detection in daylight sky.

FIG. 9 illustrates the calculation of figure of merit for IR flame detection in daylight sky. Figure of Merit for detector in 300 K ¼ sky background, 1000 K fire of 1 sq. meter.

Note that the optimum bandpass is about 1.0-2.5 microns. In order to calculate the distance a specific IR sensor might be expected to detect a fire, the flame temperature 1000 K, (wavelength) and flame size (1 $m^2$) are considered. The energy ratio of fire to background is then compared at a specific wavelength with the background at 300 K.

$$\text{Spectral_Radiant_Excitance}(\lambda, T) := \frac{2\cdot\pi\cdot c^2\cdot h}{\lambda^5\cdot\left(e^{\frac{hc}{\lambda kT}}-1\right)}$$

$$\text{Power}(z,\text{area},T): = \text{Area}\cdot 2\cdot\pi\int_{1um}^{1.8um}\text{Spectral_Radiant_Excitance}(\lambda,T)d\lambda\int_0^{\theta(z)}\sin(\theta)\cdot\cos(\theta)d\theta$$

The maximum calculated range for an available InGaAs detector and a suitable collection mirror (lens) of 0.05-0.1 m^2 is found to be about 8 km for a fire of one meter^2 cross section in daylight away from direct sunlight.

This would provide a field of view of about 10 degrees with about 8 degrees elevation viewing from a post at 20 meters elevation and a clear line of sight. Optional optical designs will provide wider FOV with less range. Optical units such as this could easily be used in a scanning mode to increase the FOV.

Figure 10:
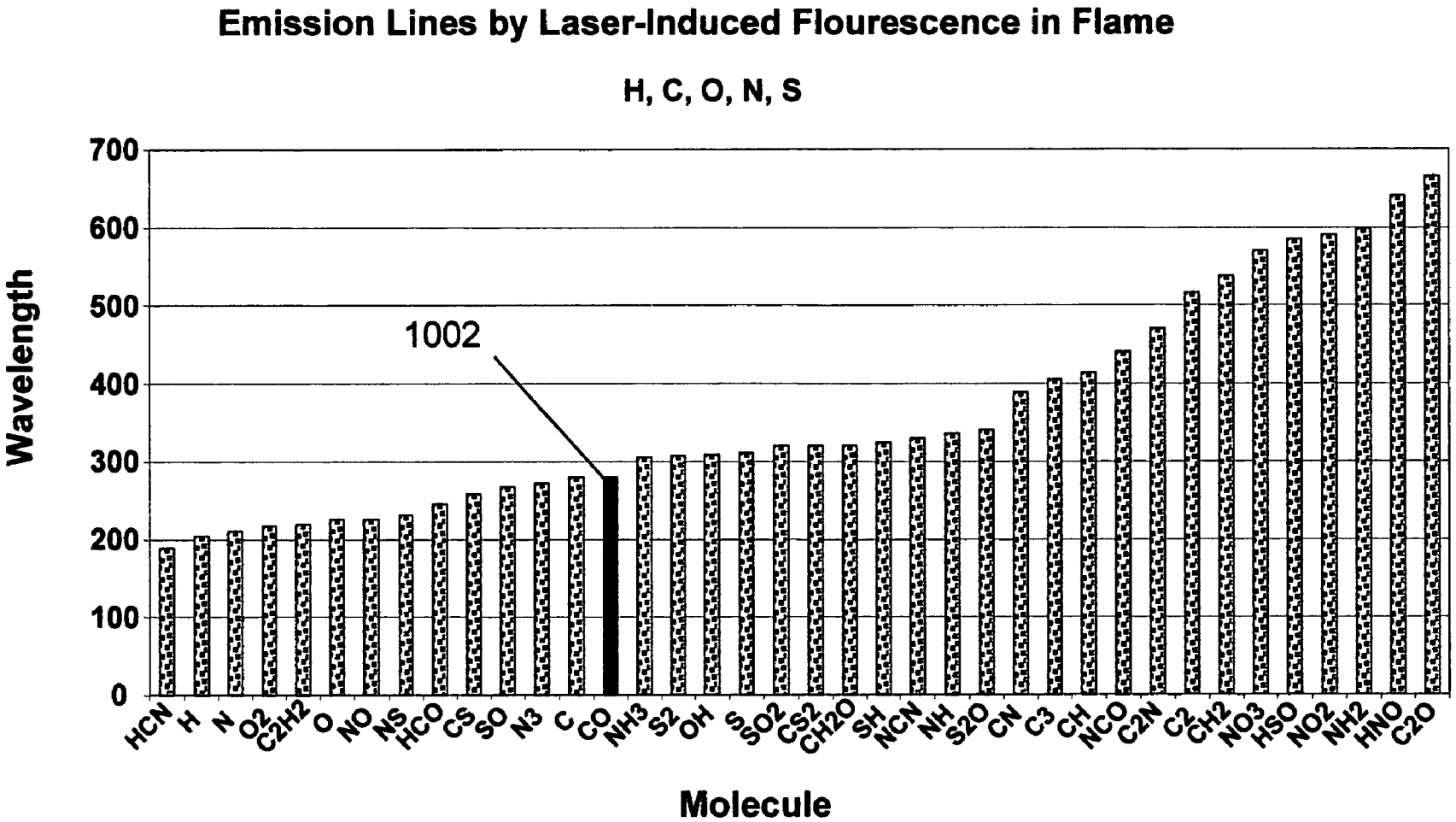
FIG. 10 shows the emission lines for several molecules produced by laser-induced fluorescence in flame.

FIG. 10 shows the emission lines for several molecules produced by laser-induced fluorescence in flame. Note that UVC emission extends to about 270 nm or the CO emission line 1002.

CONCLUSIONS

One should understand that numerous variations may be made by one skilled in the art based on the teachings herein. Such variations include but are not limited to variations in the design of the collectors or the combinations of detectors and collectors for broadband or multispectral applications. Lenses or mirrors can be used for the collection of energy from a flame.

The present invention has been described above with the aid of functional building blocks illustrating the performance of specified functions and relationships thereof. The boundaries of these functional building blocks have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. An enhanced flame detector for detecting flame in environments where the sun may come within a field of view of the enhanced flame detector, comprising:

an optical detector sensitive to the ultraviolet C range and insensitive to ultraviolet A and ultraviolet B; and a concentrator for collecting energy from a flame and directing said energy to said optical detector, said concentrator having a reflecting surface that is reflective for ultraviolet C, said concentrator providing a concentration ratio greater than 1;

wherein the concentrator is a non-imaging concentrator having an axis of symmetry of said concentrator, and the detector is substantially cylindrical with a cylindrical axis of symmetry, said detector receiving said energy from said flame through a side of said detector, said side parallel to said cylindrical axis of symmetry, and said concentrator spreads said energy across at least one dimension of said optical detector so that heating from the sun is spread across said at least one dimension of said optical detector when the sun is within said field of view of said enhanced flame detector.

2. The enhanced flame detector of claim 1, wherein the concentrator is spherical, ellipsoidal, or hyperboloidal.

3. The enhanced flame detector of claim 1, wherein the detector is a Geiger Mueller tube.

4. The enhanced flame detector of claim 1, wherein said cylindrical axis of symmetry of said optical detector is oriented parallel to said axis of symmetry of said concentrator.

5. The enhanced flame detector of claim 1, wherein the concentrator shape is based on a conic section curve and the detector has a length dimension disposed collinear with said axis of symmetry of said concentrator.

6. The enhanced flame detector of claim 1, wherein the concentrator is based on rotation of a conic section about said axis of symmetry of said concentrator, said detector is mounted with the cylindrical axis of symmetry parallel to said axis of symmetry of said concentrator for enhanced radial viewing angle while maintaining higher collection efficiencies.

7. The enhanced flame detector of claim 1, further including a cover enclosing a space within said concentrator, said cover comprising a material transparent to ultraviolet C, said cover for protection of said concentrator from contamination.

8. A method for detecting a flame with a flame detector in environments where the sun may come within a field of view of said flame detector, said flame detector comprising a concentrator and a sensor, said method comprising:

collecting and concentrating ultraviolet C energy from said flame by said concentrator to produce concentrated energy; said concentrator having an axis of symmetry, said concentrator having a reflecting surface that is reflective for ultraviolet C;

directing said concentrated energy to said sensor;

wherein the concentrated energy is distributed along a length dimension of said sensor, said detector being characterized substantially by said length dimension and a diameter dimension; said sensor receiving said energy from said flame through a side of said sensor, said side parallel to said length dimension of said sensor; and said concentrator spreads said energy across said length dimension of said sensor so that heating from the sun is spread across said length dimension of said sensor when the sun is within said field of view of said flame detector, and placing said detector with said length dimension collinear to said axis of symmetry of said concentrator.

9. An enhanced flame detector for detecting flame in environments where the sun may come within a field of view of the enhanced flame detector, comprising:

an optical detector sensitive to the ultraviolet C range and insensitive to ultraviolet A and ultraviolet B; and a concentrator for collecting energy from a flame and directing said energy to said optical detector, said concentrator having a reflecting surface that is reflective for ultraviolet C, said concentrator providing a concentration ratio greater than 1; and said concentrator spreads said energy across at least one dimension of said optical detector so that heating from the sun is spread across said at least one dimension of said optical detector when the sun is within said field of view of said enhanced flame detector, wherein the concentrator is a spherical concentrator, said spherical concentrator defined by a sphere;

said optical detector having a substantially cylindrical shape, said cylindrical shape having a cylindrical axis of symmetry, wherein said optical detector is oriented with said cylindrical axis of symmetry perpendicular to a plane tangent to said sphere defining said spherical mirror;

said detector receiving said energy from said flame through a side of said detector, said side parallel to said cylindrical axis of symmetry.

10. The enhanced flame detector of claim 9, wherein the optical detector is a Geiger Mueller tube.

* * * * *